United States Patent [19]

Faulkner

[11] 4,134,154

[45] Jan. 16, 1979

[54] BELT MEMBER AND METHOD OF CONSTRUCTING SAME

[76] Inventor: Marty Faulkner, P.O. Box 69, Fostoria, Iowa 51340

[21] Appl. No.: 816,650

[22] Filed: Jul. 18, 1977

[51] Int. Cl.[2] ..... A41F 3/02

[52] U.S. Cl. ..... 2/338

[58] Field of Search ..... 2/338, 336, 331, 317, 2/325; 87/9; 156/148

[56] References Cited

U.S. PATENT DOCUMENTS

| | | | |
|---|---|---|---|
| 261,140 | 7/1882 | Curtis | 2/338 |
| 2,274,652 | 3/1942 | Bayon | 2/338 |
| 2,821,168 | 1/1958 | Forbes | 2/338 |
| 3,829,902 | 8/1974 | Fisher | 2/338 |

*Primary Examiner*—Doris L. Troutman
*Attorney, Agent, or Firm*—Rudolph L. Lowell

[57] ABSTRACT

A flat belt member is constructed of several sections of a tubular braided polyethylene material. The sections are pressed flat to form flat strips of a double thickness having upper and lower braided layers joined together along the edges thereof. The flat strips are arranged in an abutting side by side relation and secured together along their adjacent edges to form the single flat belt member. The ends of the flat strips are fused to prevent unraveling of the braided material. A garment belt may be constructed from a length of the belt member by fastening a buckle onto one end thereof and forming buckle receiving holes in the opposite end of the garment belt.

8 Claims, 8 Drawing Figures

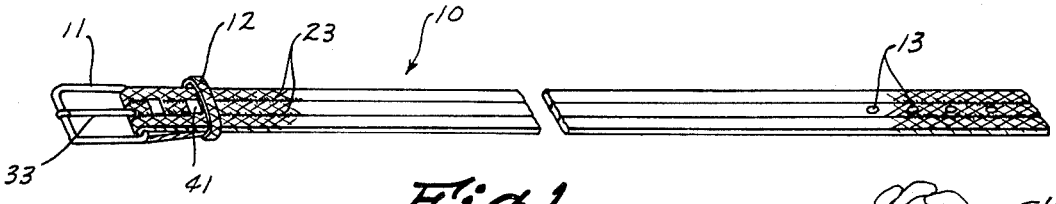
Fig. 1
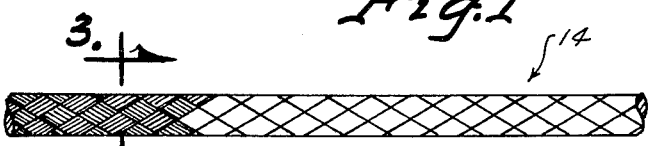
Fig. 2
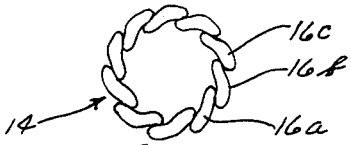
Fig. 3
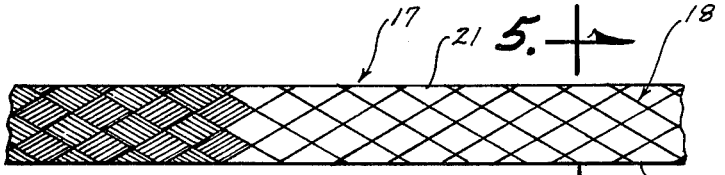
Fig. 4
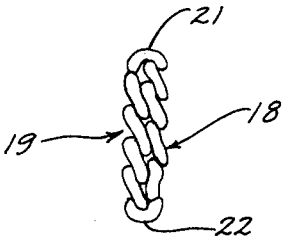
Fig. 5
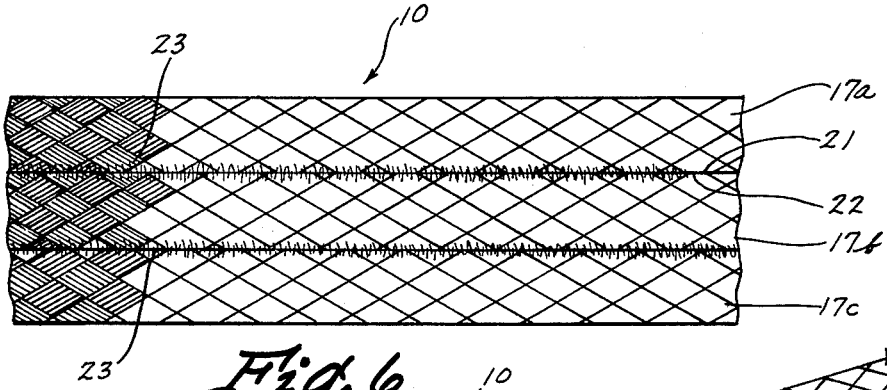
Fig. 6
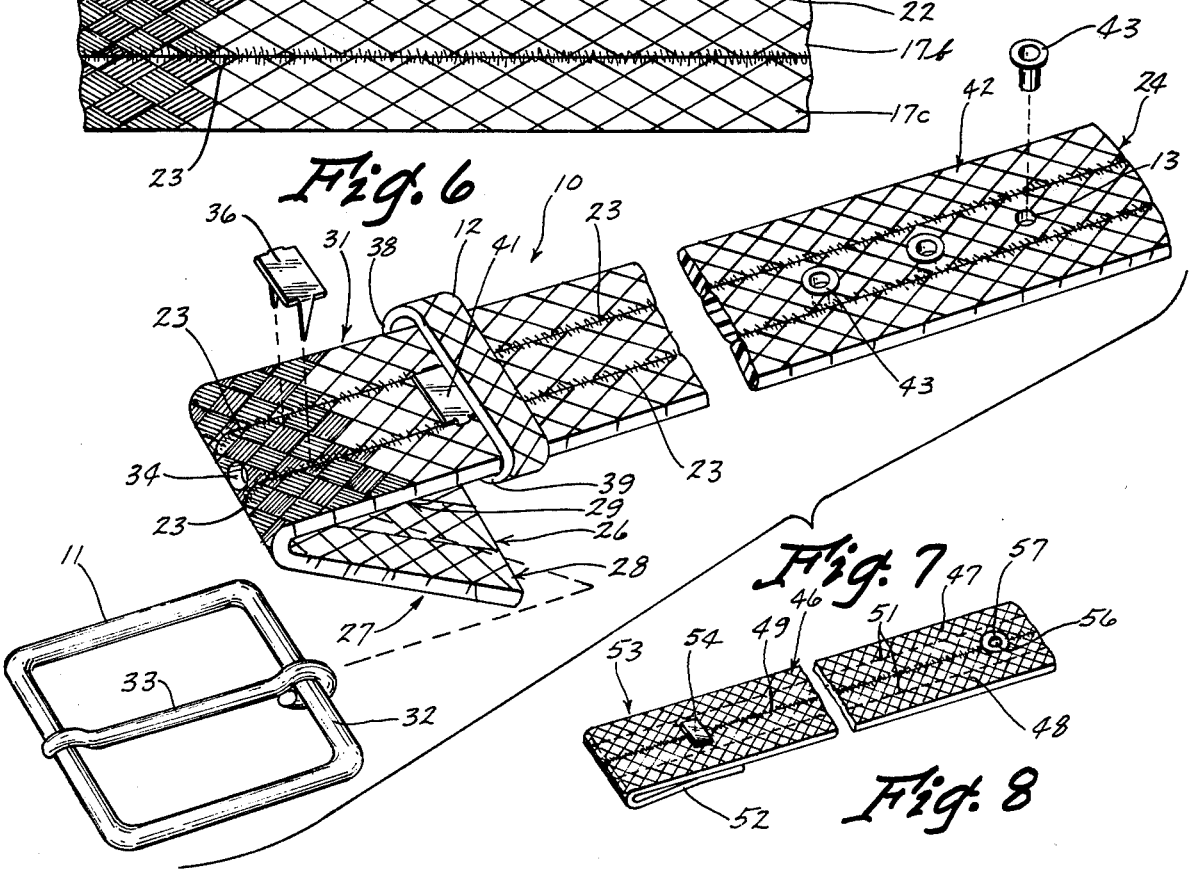
Fig. 7
Fig. 8

BELT MEMBER AND METHOD OF CONSTRUCTING SAME

SUMMARY OF THE INVENTION

The belt member of the present invention is constructed of sections of a tubular braided polyethylene material. The sections are pressed into flat strips which are arranged side by side and sewed together along their adjacent edges. Any number of flat strips may be used to form belt members of various widths. Such belt members are flexible, resilient, and particularly strong in tension. Center stitching longitudinally of the individual strips further increases the tensile strength of the belt member. With strips constructed of braided polyethylene strands and sewed together with nylon thread, the belt member is resistant to deterioration by moisture, weather conditions and dirt. The problems associated with the unraveling of a polyethylene material are avoided since opposite ends of the belt member and the side walls of any holes formed in the belt member are fused by the application of heat thereto. The belt member is readily adaptable for use as a garment support by connecting a buckle and belt loop to one end of a length of the belt member and forming several belt holes adjacent the opposite end. Grommets may be fastened in the belt holes to protect the fused side walls thereof.

BRIEF DESCRIPTION OF THE DRAWINGS

FIG. 1 is a perspective view of a garment belt;

FIG. 2 is a plan view of a portion of a tubular shaped braided polyethylene material from which the garment belt of FIG. 1 is constructed;

FIG. 3 is an enlarged sectional view of the tubular braid, taken along line 3—3 in FIG. 2;

FIG. 4 is a plan view of a portion of a flat strip formed by flattening the tubular shaped braid of FIG. 2;

FIG. 5 is an enlarged sectional view of the flat strip taken along line 5—5 in FIG. 4;

FIG. 6 is a plan view of a portion of a belt member constructed from three of the flat strips shown in FIG. 4;

FIG. 7 is an enlarged, foreshortened and partially exploded perspective view of the garment belt of FIG. 1; and FIG. 8 is a foreshortened perspective view of another embodiment of the invention.

DETAILED DESCRIPTION OF THE INVENTION

The flat belt member of the present invention, indicated generally at 10 in FIG. 1, is shown formed as a garment belt having a buckle 11 and belt loop 12 at one end and several belt holes 14 formed adjacent the opposite end.

Construction of the belt member 10 begins with the provision of several elongated hollow sections 14 (FIGS. 2 and 3) of a tubular shaped braided polyethylene material. Each section 14 consists of several clusters 16*a*, 16*b*, etc. of elongated plastic strands, with the clusters interwoven to form a single tubular flexible section 14. The section 14 shown includes ten clusters of polyethylene strands.

Several of the sections 14 are flattened to form elongated double thickness flat strips 17 (FIGS. 4 and 5) each of which has an upper layer 18 and a lower layer 19 having joined side edges 21 and 22. The sections 14 may be flattened by passing them between a pair of closely spaced rollers (not shown). It has been found that passing the polyethylene sections through steel rollers imparts a glossy sheen to the flat surfaces of the strips 17.

The belt member 10 is formed by arranging two of the flat strips 17 in side by side relation so that the edges or sides 21 and 22 of adjacent strips are in abutting engagement as seen in FIG. 6. The strips are then fastened together along the abutting sides to complete a single belt member 10.

Referring to FIG. 6, three strips 17*a*, 17*b* and 17*c* are arranged in a side-by-side relation with the abutting sides 21 and 22 of adjacent strips sewed together with a thread or monofilament 23 for continuous and uniform connection along the lengths thereof. A clear monofilament is advantageous for aesthetic purposes since it tends to obscure itself with the strips.

A particular application for the belt member 10 is that of a garment belt as shown in FIG. 1, and in greater detail in FIG. 7. The belt member 10 is cut to length, after which both ends 24 and 26 of the cut length are fused to prevent the polyethylene strands of the material from unraveling. Fusing of the ends 24 and 26 is accomplished by the application of heat to the frayed ends, whereby the plastic strands are melted or bonded together to present a continuous end surface. Fusing the ends of the belt also serves to secure together the ends of adjacent strips 17*a*, 17*b* and 17*c* so as to reduce the stress on the thread 23 in a direction transversely of the belt at the ends of the strips.

One end portion 27 of the cut length of the belt member 10 is folded under on itself so that the lower layer 28 thereof engages the lower layer 29 of the adjacent belt portion 31. The cross member 32 of the belt buckle 11 is then received between the lower layers 28 and 29 currently with the insertion of the tongue 33 on the cross member 32 into a hole 34 formed centrally at the juncture of the adjacent end portions 27 and 31. The belt portions 27 and 31 are then secured together by a staple 36.

The belt loop 12, formed of a single strip 17 of a length approximately equal to twice the width of the belt, is arranged transversely of the garment belt with both ends 38 and 39 of the belt loop folded under the adjacent belt portion 31. The free end of the folded under portion 27 is brought up into engagement with the belt loop ends 38 and 39 and fastened thereto with a second staple 41.

The holes 13 formed in an opposite end portion 42 of the garment belt are spaced longitudinally approximately one inch apart. The sidewalls of the holes 13, when formed by a cutting tool, are defined by the cut ends of plastic strands so as to permit hole enlargement and deterioration by the strands becoming unraveled in use. To eliminate this condition the holes are formed by a heated tool whereby the strands are heat fused together concurrently with what may be called the "burning out" of the holes. This same fusing together of the strands may be accomplished by the application of heat to the side walls of holes formed by a cutting tool. The holes 13 may be quickly formed with a hot metal rod pressed through the center strip 17*b* to simultaneously cut and fuse the belt holes 13. The side wall of the tongue hole 34 and any other holes to be formed through the belt material are similarly fused.

A plastic or metal eyelet 43 is inserted into each belt hole 13 to reinforce the sidewalls of the belt holes 13 for receiving the tongue 33.

A second embodiment of the invention, shown in FIG. 8, is adapted for use as a strap for hanging an article on a hook or the like. A strap member 46 includes two flat pressed strips 47 and 48 sewn together with clear monofilament 49. In addition, the upper and lower layers of each strip 47 and 48 are sewed together along the longitudinal center lines thereof with a heavy nylon thread 51 to prevent the pressed strips 47 and 48 from slipping or giving in at the center under heavy loads. One end portion 52 of the belt 46 is folded under and fastened to the adjacent belt portion 53 with a rivet 54. A large hole 45 is formed in the opposite end of the belt with a grommet 57 fastened in the hole to reinforce the side wall of the hole for engaging the hook (not shown) from which the strap 46 may be hung.

It is apparent that the braided material of the tubular sections 14 is commercially available in different color schemes and patterns so that a belt member 10 is of colorful and appealing design in appearance. When formed into a garment belt, color combinations can be used to complement the garment color. The belt member 10 is flexible, strong, and durable so as to function as a seat belt in automobiles provided in an appealing color within the color decor of the automobile interior.

Although the invention has been described with respect to preferred embodiments thereof, it is to be understood that it is not to be so limited since changes and modifications can be made therein which are within the full intended scope of this invention as defined by the appended claims.

I claim:

1. A method for constructing a garment belt from a plurality of sections of a tubular shaped braided heat fusible material, comprising:

(a) flattening each tubular section to form an elongated double thickness flat strip having an upper layer and a lower layer joined together along the side edges thereof, (b) arranging a plurality of the strips in a side by side relation with the sides of adjacent strips in abutting engagement, (c) fastening together the adjacent sides of adjacent strips to form a single flat garment belt, (d) forming a hole through said garment belt, and (e) heat fusing the edges of the hole to prevent the braided material from unraveling.

2. The method for constructing a garment belt, according to claim 2, including:

(a) fastening a grommet into the hole in said garment belt.

3. The method for constructing a garment belt according to claim 2, including:

(a) folding under one end portion of the garment belt whereby the lower layer of said one end portion is engaged against the lower layer of an adjacent belt portion, (b) sliding a cross member of a buckle onto said one end portion between said engaged lower layers, (c) fastening together said one end portion and said adjacent belt portion to retain the buckle between them, (d) forming a plurality of longitudinally spaced holes through an opposite end portion of said garment belt, and (e) heat fusing the edges of said holes to prevent the braided material from unraveling.

4. The method for constructing a garment belt, according to claim 3, including:

(a) arranging a flattened braided strip transversely of and above said adjacent belt portion, (b) folding both ends of said transverse strip under said adjacent belt portion, and (c) fastening together said adjacent belt portion, said one end portion and said ends of the transverse strip.

5. A garment belt comprising:

(a) a plurality of flattened sections of a tubular heat fusible braided material, each section comprising an elongated double thickness flat strip having an upper layer and a lower layer joined together along the side edges thereof, (b) said strips arranged in a side by side relation with the sides of adjacent strips in abutting engagement, (c) fastening means for fastening together the adjacent sides of adjacent strips to form a single flat garment belt, (d) said garment belt having a hole therethrough with a side wall comprising ends of the braided material, and (e) said side wall heat fused to prevent unraveling of the braided material.

6. The garment belt, according to claim 5, including:

(a) a grommet inserted into said hole and fastened to the garment belt.

7. The garment belt, according to claim 5, including:

(a) one end portion of said garment belt folded under for engagement of the lower layer thereof with the lower layer of an adjacent belt portion, (b) a buckle having a cross member situated between said adjacent belt portions, (c) means for fastening said one end portion and said adjacent belt portion together to retain the buckle cross member therebetween, (c) an opposite end portion of said garment belt having a plurality of longitudinally spaced holes formed therein, said holes having respective side walls, and (e) said respective side walls heat fused to prevent unraveling of the braided material.

8. The garment belt, according to claim 7, including:

(a) a flat strip of braided material arranged transversely of said adjacent belt portion, (b) said transverse flat strip having opposite end portions folded under said adjacent belt portion, and (c) means for fastening together said adjacent belt portion, said opposite end portions of the transverse flat strip and said one end portion of the garment belt.

* * * * *